US008740012B2

(12) United States Patent
Ekkert

(10) Patent No.: US 8,740,012 B2
(45) Date of Patent: Jun. 3, 2014

(54) BOTTLE HAVING ARCUATE MOUTH AND CLOSED CIRCULAR SEGMENT RIM WITH RIBS

(75) Inventor: Len Ekkert, Lemont, IL (US)

(73) Assignee: Phoenix Closures, Inc., Naperville, IL (US)

( * ) Notice: Subject to any disclaimer, the term of this patent is extended or adjusted under 35 U.S.C. 154(b) by 88 days.

(21) Appl. No.: 13/557,764

(22) Filed: Jul. 25, 2012

(65) Prior Publication Data

US 2013/0092650 A1 Apr. 18, 2013

Related U.S. Application Data

(60) Provisional application No. 61/546,287, filed on Oct. 12, 2011.

(51) Int. Cl.
*B65B 7/28* (2006.01)
*B65D 41/04* (2006.01)
*B44D 3/14* (2006.01)

(52) U.S. Cl.
USPC ..... 220/698; 220/570; 220/571.1; 220/695; 220/700; 220/733; 220/601; 220/608; 215/41; 215/42; 215/44; 215/227; 215/228; 215/371; 215/391

(58) Field of Classification Search
USPC ..... 220/570–573, 695–702; D9/434; 215/40–44, 227, 228, 371–378, 215/390–394
See application file for complete search history.

(56) References Cited

U.S. PATENT DOCUMENTS

| | | | | | |
|---|---|---|---|---|---|
| 102,646 | A | * | 5/1870 | Armington | 220/695 |
| 1,293,951 | A | * | 2/1919 | Shevalier | 220/495.02 |
| 1,471,960 | A | | 12/1919 | Henry | |
| 1,599,967 | A | * | 9/1926 | Johnson | 222/465.1 |
| 1,865,736 | A | * | 7/1932 | Astley | 220/695 |
| 1,875,379 | A | | 9/1932 | Holmes | |
| 1,984,170 | A | * | 12/1934 | Archbold, Jr. | 220/695 |
| D107,540 | S | * | 12/1937 | McHale | D32/53 |
| 2,124,929 | A | * | 7/1938 | Reid | 220/700 |
| 2,180,581 | A | * | 11/1939 | Eisenberg | 220/697 |
| 2,324,338 | A | * | 7/1943 | Tripp | 222/541.6 |
| 2,418,502 | A | * | 4/1947 | Ferguson | 220/797 |
| 2,436,924 | A | * | 3/1948 | Hansen | 211/65 |
| 2,591,482 | A | * | 4/1952 | Weltlich | 220/700 |
| 2,660,333 | A | * | 11/1953 | Paxton | 220/701 |
| 2,765,094 | A | * | 10/1956 | Ryan | 220/835 |
| 2,873,052 | A | * | 2/1959 | Atherton | 222/570 |
| 2,903,154 | A | * | 9/1959 | Hendershot | 220/697 |
| 2,941,692 | A | * | 6/1960 | Kappel | 220/697 |
| 3,016,169 | A | * | 1/1962 | Kirshenbaum | 222/192 |
| 3,022,916 | A | | 2/1962 | Spooner | |
| 3,133,668 | A | * | 5/1964 | Heise | 220/701 |
| 3,168,962 | A | * | 2/1965 | Rawlins et al. | 220/697 |
| 3,221,955 | A | * | 12/1965 | Banaszak et al. | 222/570 |
| 3,223,272 | A | * | 12/1965 | Vernon | 220/801 |
| 3,275,187 | A | * | 9/1966 | Lamoureaux | 220/700 |
| 3,298,561 | A | * | 1/1967 | McConnie | 220/695 |

(Continued)

*Primary Examiner* — Anthony Stashick
*Assistant Examiner* — Ned A Walker
(74) *Attorney, Agent, or Firm* — Husch Blackwell LLP

(57) ABSTRACT

A heat-sealable, plastic bottle with an internal scraper and an inner seal is described. More particularly, the present application relates to a heat-sealable, plastic bottle having an opening with an internal scraper chord that is less than or equal to the diameter of the circular opening, an inner seal, and a cap.

10 Claims, 9 Drawing Sheets

(56) References Cited

U.S. PATENT DOCUMENTS

| | | | | | |
|---|---|---|---|---|---|
| 3,329,307 | A | * | 7/1967 | Jacobson | 220/695 |
| 3,667,079 | A | * | 6/1972 | Hagglund | 15/105 |
| 3,679,103 | A | * | 7/1972 | Chmela et al. | 222/192 |
| 3,688,943 | A | * | 9/1972 | Brown | 220/697 |
| 3,767,076 | A | | 10/1973 | Kennedy | |
| 3,815,774 | A | * | 6/1974 | Olsson | 220/200 |
| 3,844,457 | A | * | 10/1974 | Smart | 222/570 |
| 3,894,650 | A | * | 7/1975 | Crump | 220/701 |
| 3,980,213 | A | * | 9/1976 | Ramsay | 222/485 |
| 4,014,465 | A | * | 3/1977 | Ritter | 222/563 |
| D245,672 | S | * | 9/1977 | Grantham | D9/447 |
| 4,109,815 | A | | 8/1978 | Collins, III | |
| 4,125,210 | A | * | 11/1978 | Embree | 222/570 |
| D254,482 | S | * | 3/1980 | Bell | D9/435 |
| 4,203,537 | A | * | 5/1980 | McAlister | 222/570 |
| 4,225,064 | A | * | 9/1980 | Westcott | 222/569 |
| 4,266,686 | A | * | 5/1981 | Carter | 220/697 |
| D260,735 | S | * | 9/1981 | Heath | D9/447 |
| 4,378,892 | A | | 4/1983 | Ochs et al. | |
| 4,494,267 | A | * | 1/1985 | Fredley | 15/104.92 |
| 4,561,556 | A | * | 12/1985 | Bendix | 220/697 |
| 4,583,666 | A | * | 4/1986 | Buck | 222/109 |
| 4,893,723 | A | * | 1/1990 | Seabolt | 220/570 |
| 4,969,617 | A | * | 11/1990 | Desjardins | 248/146 |
| D321,325 | S | * | 11/1991 | Petrus | D9/435 |
| 5,392,969 | A | * | 2/1995 | Usery | 222/570 |
| 5,662,242 | A | * | 9/1997 | Steo | 220/695 |
| 5,669,526 | A | * | 9/1997 | Keyfauver | 220/696 |
| 5,893,489 | A | * | 4/1999 | Giarrante | 222/482 |
| 6,102,235 | A | * | 8/2000 | Stern et al. | 220/212 |
| D432,421 | S | * | 10/2000 | Sullivan, Jr. | D9/440 |
| D438,680 | S | * | 3/2001 | Cogdill | D32/53 |
| 6,199,718 | B1 | * | 3/2001 | Ellis | 220/735 |
| D458,844 | S | * | 6/2002 | Shea | D9/447 |
| 6,530,500 | B2 | * | 3/2003 | Bravo et al. | 222/143 |
| 6,634,525 | B2 | * | 10/2003 | Bravo et al. | 222/143 |
| D489,261 | S | * | 5/2004 | Doelling | D9/447 |
| 6,761,283 | B1 | | 7/2004 | Gilliam et al. | |
| 6,772,904 | B1 | * | 8/2004 | Gilliam et al. | 220/836 |
| 6,896,156 | B2 | * | 5/2005 | McDonald et al. | 222/109 |
| 6,983,862 | B2 | * | 1/2006 | Nottingham et al. | 222/109 |
| 7,080,152 | B2 | * | 7/2006 | Bodin et al. | 709/231 |
| 7,134,574 | B2 | * | 11/2006 | Braunstein et al. | 222/108 |
| 7,155,058 | B2 | * | 12/2006 | Gaubatz et al. | 382/167 |
| 7,162,637 | B2 | * | 1/2007 | Wakao et al. | 713/176 |
| 7,177,488 | B2 | * | 2/2007 | Berkner et al. | 382/298 |
| 7,225,944 | B2 | | 6/2007 | Heinicke et al. | |
| 7,325,687 | B2 | * | 2/2008 | Bravo et al. | 206/509 |
| 7,703,641 | B2 | * | 4/2010 | Bravo et al. | 222/465.1 |
| 7,770,745 | B2 | | 8/2010 | Weissmann et al. | |
| D664,320 | S | * | 7/2012 | Sakko | D32/54 |
| 8,376,181 | B2 | * | 2/2013 | Lundgreen et al. | 220/805 |
| 2006/0226156 | A1 | * | 10/2006 | Lundy et al. | 220/570 |
| 2007/0012705 | A1 | * | 1/2007 | Bergman | 220/696 |
| 2009/0261113 | A1 | | 10/2009 | Miota et al. | |
| 2011/0284545 | A1 | * | 11/2011 | Lundgreen et al. | 220/363 |

* cited by examiner

BOTTLE HAVING ARCUATE MOUTH AND CLOSED CIRCULAR SEGMENT RIM WITH RIBS

FIELD

The present application pertains to a heat-sealable, plastic bottle with an internal scraper, an inner seal and, optionally, a cap. An assembly of such a bottle, an inner seal and a cap is also described herein.

BACKGROUND

There is tremendous use of heat-sealable, plastic bottles worldwide for they are convenient for the consumer and relatively inexpensive to make. Many food and medicinal products can be contained within these bottles. An inner seal attached to the bottle underneath the cap prevents leakage of the bottle contents and can provide an indication of tampering with the contents of the bottle.

In the use of such bottles, most often a utensil, such as a spoon, is utilized to remove the product from the bottle. However, there is no convenient way to level the contents of the spoon for the precise measurement of product. Methods such as tapping the spoon or leveling the spoon with a second utensil are wasteful, messy and cumbersome. Thus, a need exists for a bottle having a convenient means to remove excess product from the spoon as it is withdrawn from the bottle.

In addition, a need exists for a bottle having an attached an inner seal on the rim of the opening of the bottle to minimize bacterial contamination and to minimize leakage of the product contained therein.

Accordingly, an object of the present invention is to provide an improved, heat-sealable plastic bottle with an internal scraper and having an inner seal attached to the rim of the bottle opening.

BRIEF SUMMARY

One embodiment of the present invention contemplates a heat-sealable, plastic bottle having an opening and a rim including a circumferential sealing surface that forms the opening. The sealing surface has a chord section with an internal scraping surface. The chord can be a straight line segment, a curved line segment or two or more intersecting line segments. In one embodiment, there can be a buttress supporting the chord section. An inner seal is adhered to the sealing surface of the rim. There is an external surface adjacent to the chord that is not part of the sealed surface.

The present invention has several benefits and advantages. One benefit is that the internal scraper facilitates the accurate measurement of product contained within the bottle. Another benefit is that the inner seal provides evidence of possible tampering when the bottle contents have been disturbed before the consumer opens the bottle. Another particular benefit is that the product contained within the bottle is prevented from spilling or leaking by the inner seal. Further benefits and advantages will be apparent to the worker of ordinary skill from the disclosure that follows.

DETAILED DESCRIPTION

Figure 1:
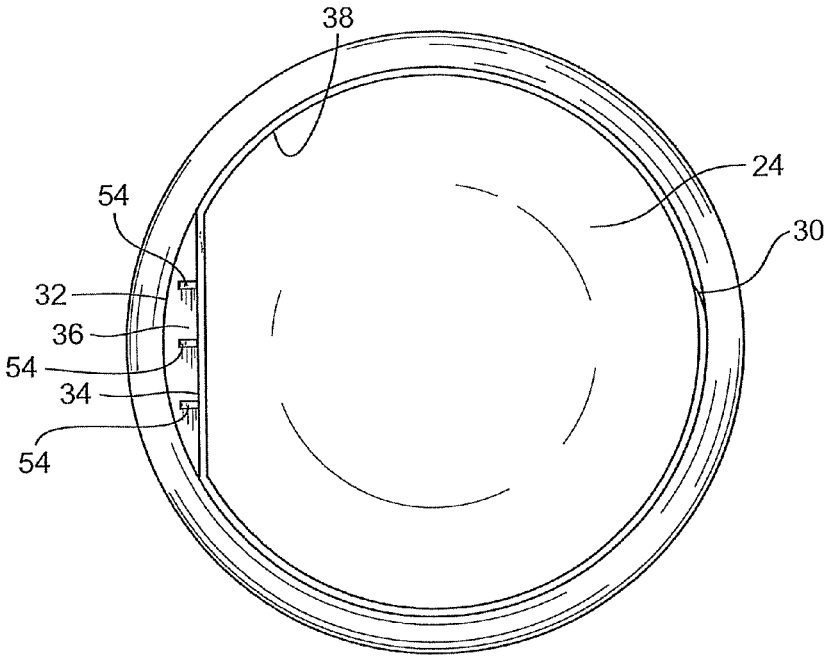
FIG. 1 illustrates one example of a heat-sealable plastic bottle that contains an inner seal surface and an internal scraper with a view from the top.

While embodiments of this invention can take many different forms, specific embodiments thereof are shown in the drawings and will be described herein in detail with the understanding that the present disclosure is to be considered as an exemplification of the principles of the invention, and is not intended to limit the invention to the specific embodiment illustrated.

Figure 11:
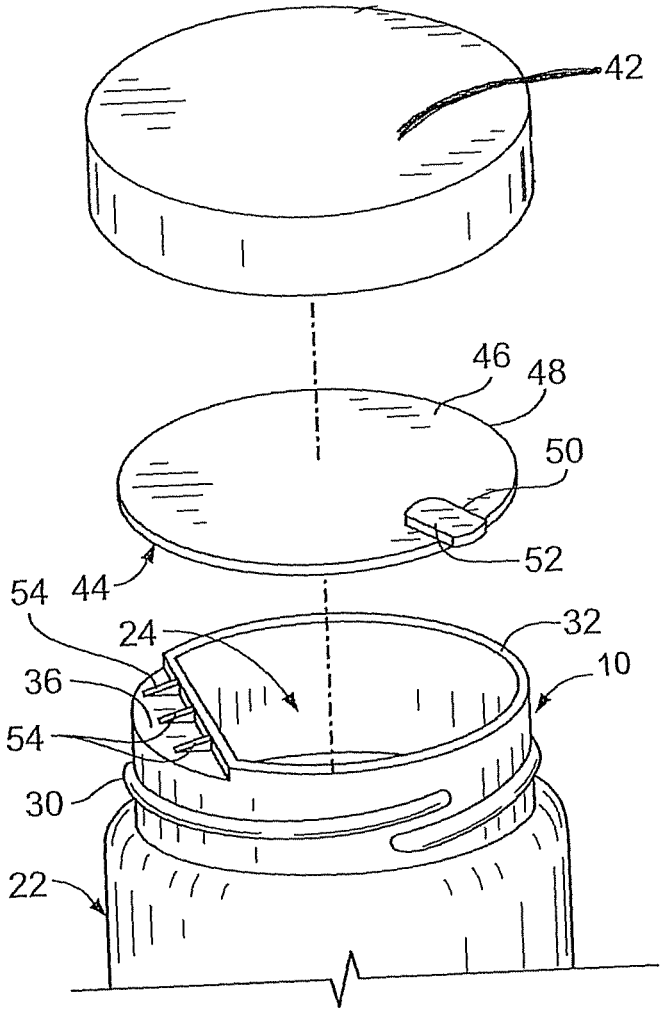
FIG. 11 illustrates a side view of a heat-sealable plastic bottle that contains an inner seal surface and an internal scraper.
Figure 12:
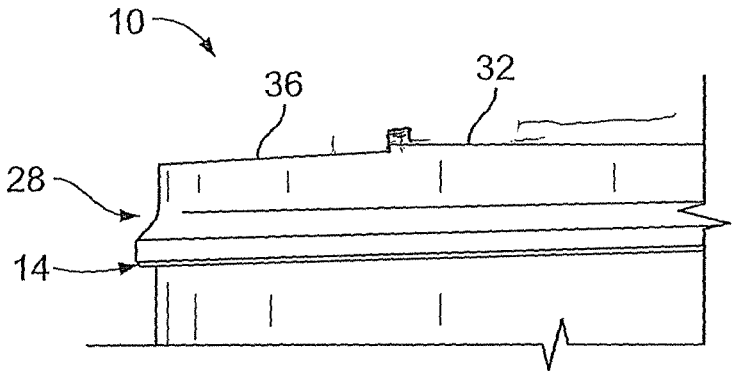
FIG. 12 illustrates a side view of a heat-sealable plastic bottle that contains an inner seal surface and an internal scraper.
Figure 13:
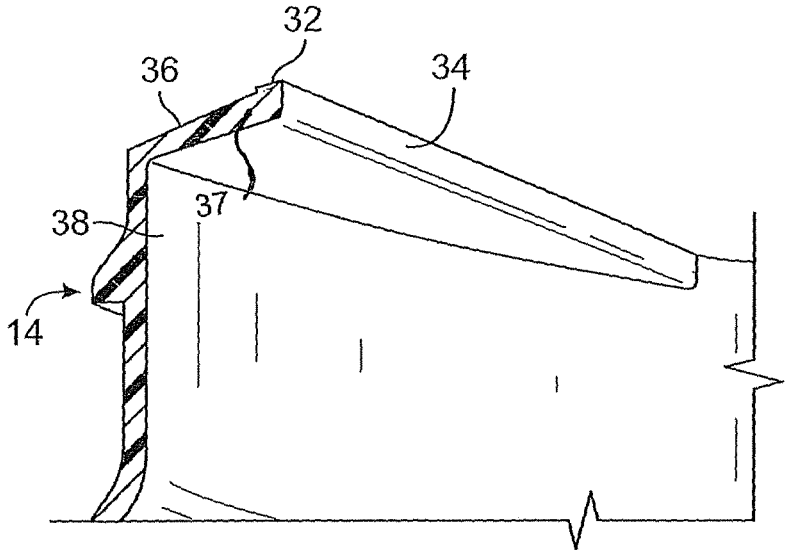
FIG. 13 illustrates an internal view of a heat-sealable plastic bottle that contains an inner seal surface and an internal scraper.
Figure 14:
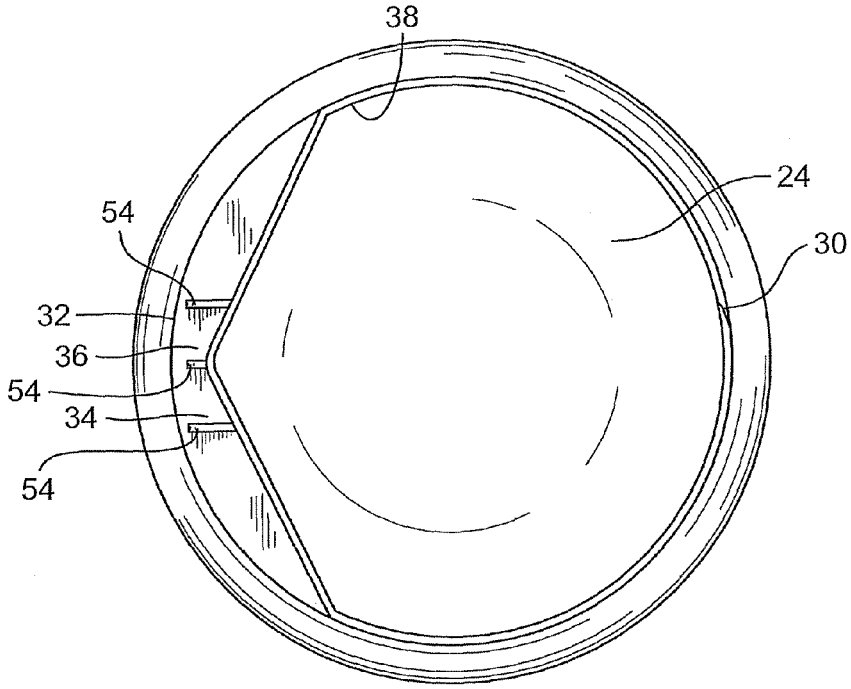
FIG. 14 illustrates a top view of a heat-sealable plastic bottle that contains an inner seal surface and an internal scraper.
Figure 15:
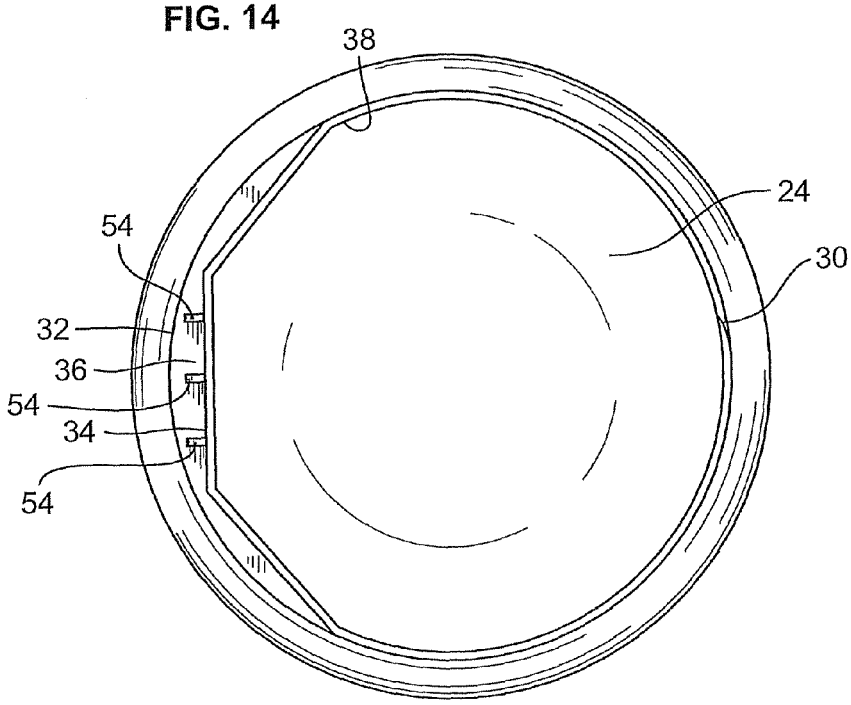
FIG. 15 illustrates a top view of a heat-sealable plastic bottle that contains an inner seal surface and an internal scraper.

As shown in FIGS. 1-16, the present application relates to a heat-sealable, plastic bottle (10) having an internal scraper wall (36) that terminates in a chord of the circumferential sealing surface. The flat upper surface of the internal scraper wall (36) has a terminal edge or surface (34) (FIG. 1) that can be a straight line segment, a curved line segment (FIG. 16), or two or more intersecting line segments (FIGS. 14 and 15). There is an inner seal that can be adhered to the rim (32) of the bottle (FIG. 11). The upper surface of the internal scraper wall (36) may be on a side opposite to the thread (30) start.

Figure 2:
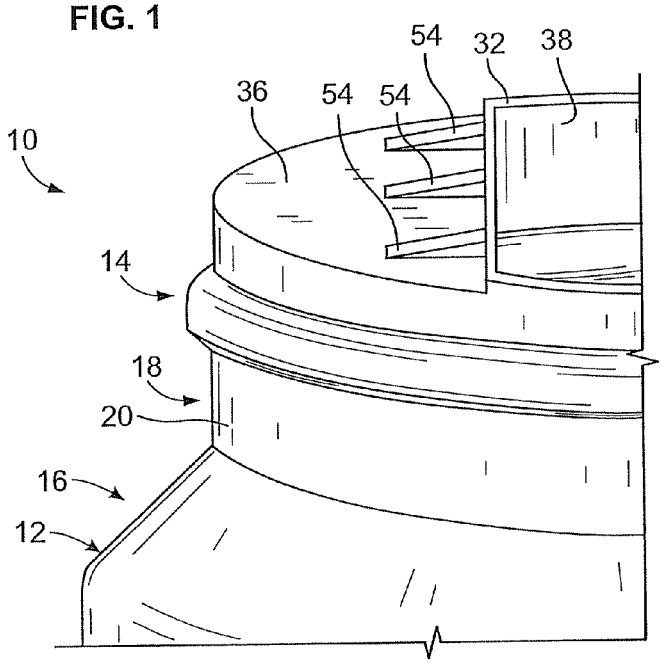
FIG. 2 illustrates a side view of a heat-sealable plastic bottle that contains an inner seal surface and an internal scraper.
Figure 3:
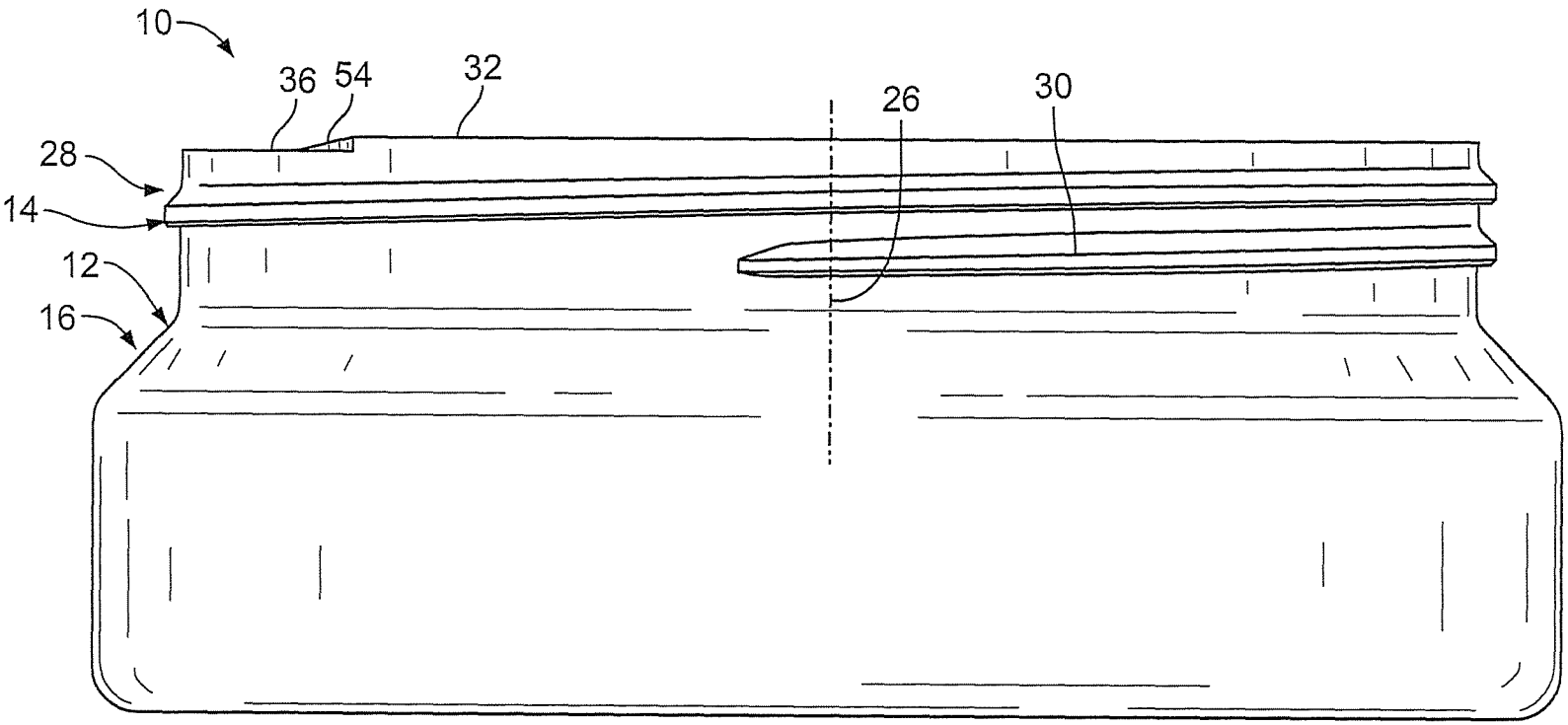
FIG. 3 illustrates a side view of a heat-sealable plastic bottle that contains an inner seal surface and an internal scraper.
Figure 4:
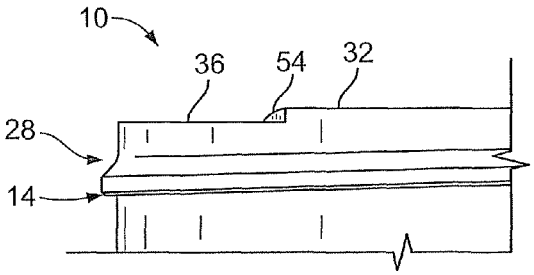
FIG. 4 illustrates a side view of a heat-sealable plastic bottle that contains an inner seal surface and an internal scraper.
Figure 5:
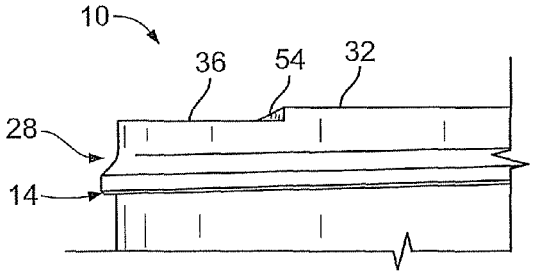
FIG. 5 illustrates a side view of a heat-sealable plastic bottle that contains an inner seal surface and an internal scraper.
Figure 6:
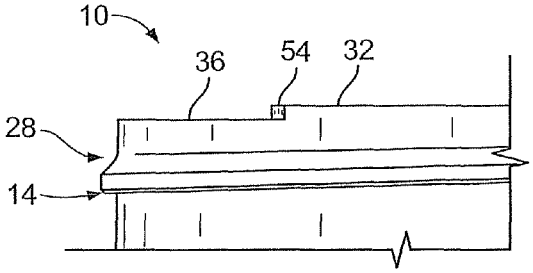
FIG. 6 illustrates a side view of a heat-sealable plastic bottle that contains an inner seal surface and an internal scraper.
Figure 7:
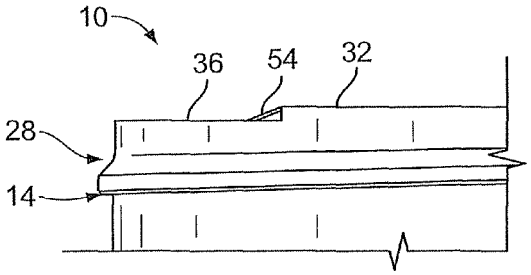
FIG. 7 illustrates a side view of a heat-sealable plastic bottle that contains an inner seal surface and an internal scraper.
Figure 8:
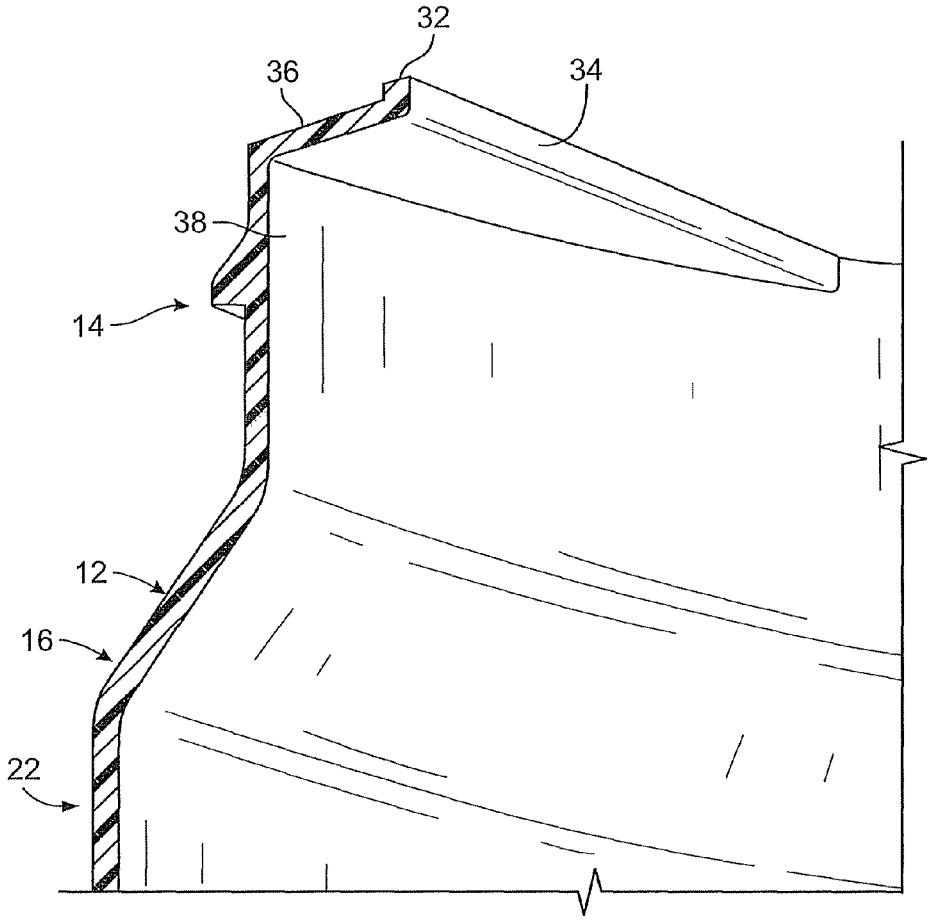
FIG. 8 illustrates an internal view of a heat-sealable plastic bottle that contains an inner seal surface and an internal scraper.
Figure 9:
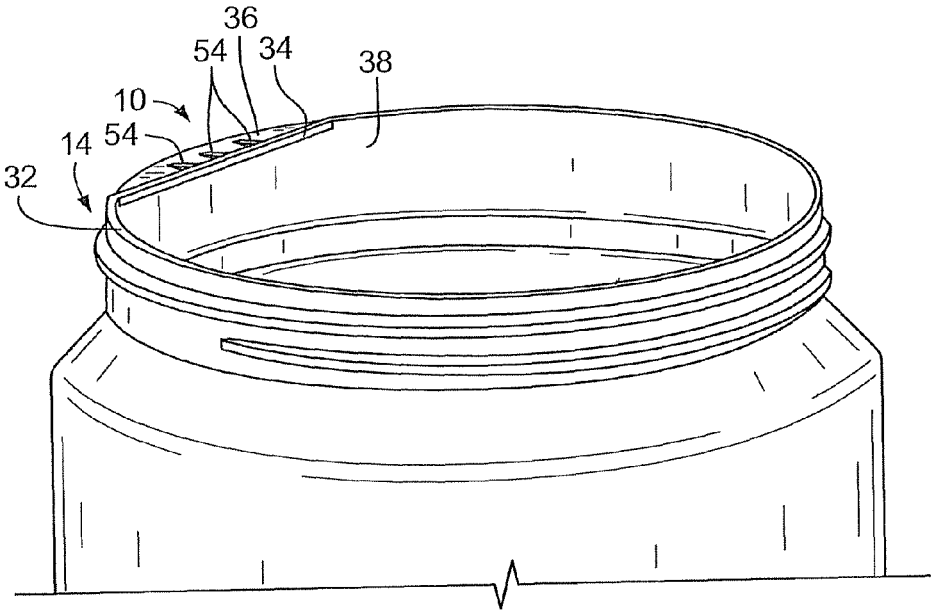
FIG. 9 illustrates a side view of a heat-sealable plastic bottle that contains an inner seal surface and an internal scraper.
Figure 10:
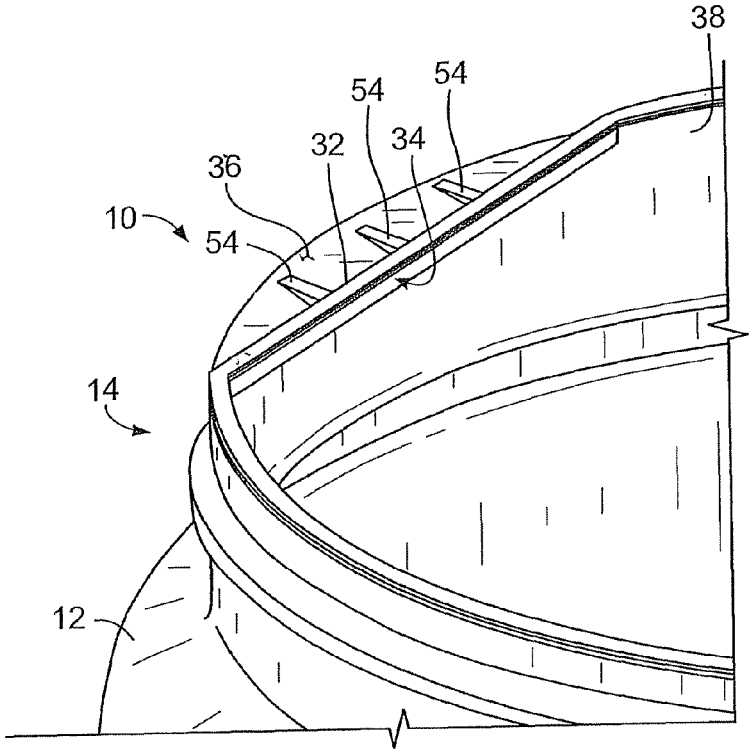
FIG. 10 illustrates a top view of a heat-sealable plastic bottle that contains an inner seal surface and an internal scraper.

As shown in FIG. 2, the plastic bottle (10) is defined by a body (12) with a lower section and includes an upper neck (14) having an upper section (18) forming a finish (20). The finish (20) is that portion of the bottle (10) including the upper section (14) that engages the cap (42) (FIG. 9-12). Integrally formed with the finish (20) and extending down is a shoulder (16). The shoulder region (16) connects with the finish (20) and the lower section (22) of the body.

Figure 16:
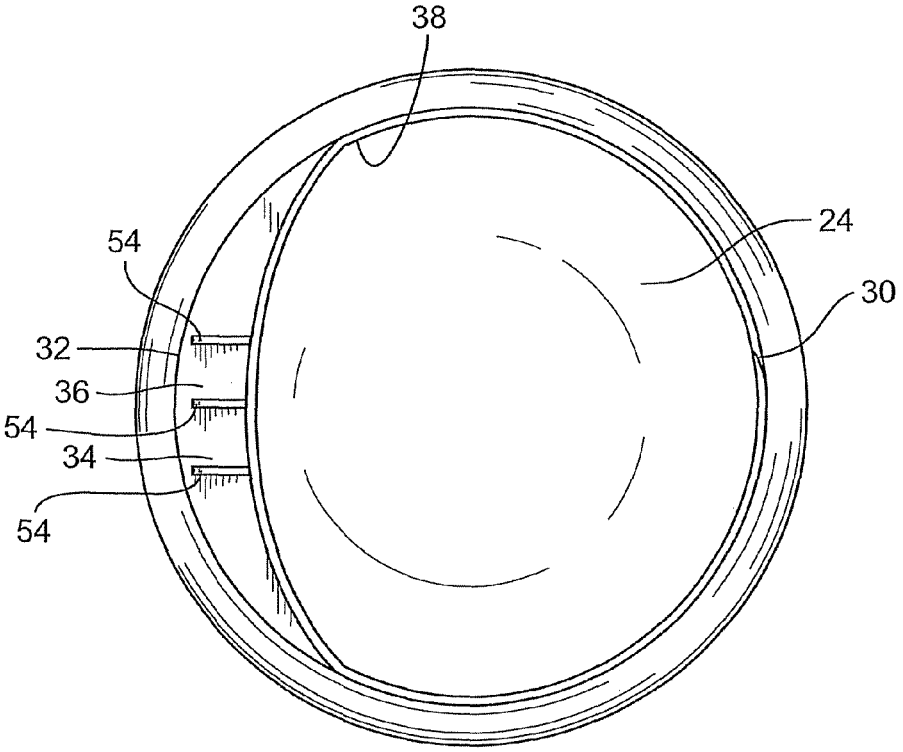
FIG. 16 illustrates a top view of a heat-sealable plastic bottle that contains an inner seal surface and an internal scraper.

The upper neck (14) defines a planar opening (24). The opening (24) provides access for a user to remove product from within the bottle (10). The plane of the opening (24) is perpendicular to a longitudinal axis (26) of the bottle (10) to produce a planar sealing surface to which an inner seal is adhered. The opening (24) of the bottle (10) defines a circumferential barrier (38) having an internal scraper surface (34). The internal scraper surface (34) is a terminal edge that is generally less than or equal to the diameter of the opening (24), though it can be more. The terminal edge (34) can be a straight line segment, a curved line segment or two or more intersecting line segments (FIGS. 14, 15, 16). The terminal edge is useful for scraping excess product from the spoon as it is withdrawn from the bottle (10). The internal scraper surface (36) should be on the same horizontal plane as the opening (24). The internal scraper edge (34) is generally in contact with the inner seal when applied.

It is possible during the molding process, that the internal scraper will warp in the molding process. To counteract this possibility, the internal scraper surface (36) can be fortified by a buttress (54) located on the top surface of the internal scraper surface (36). The buttress (54) (FIGS. 1 and 2) is engaged with the surface of the rim (32). The buttresses (54) can include a solid flat support, a solid rounded support, an angled strap support or mixtures thereof (FIGS. 3-7). In this manner an effective seal of the cap on the sealing surface of the rim can be assured. In one embodiment, (FIG. 1, 2) more than one buttress (54) can be found on the top surface of the internal scraper (36). In another embodiment, no buttress is present.

In another embodiment, the upper surface of the internal scraper 36 can be at an angle or rounded sloping up to the rim 32 (FIG. 12) and raising a little bit above the overall plane of the rim. In this structure, when the cap is tightened on the rim 32, it pushes the rim 32 down, gaining both structural integrity and a continuous seal on the rim. Thus, when the cap is tightened, it forces the rounded or angles chord into the plane of the circular portion of the rim to make the seal. In another embodiment, the internal scraper wall 37 can increase in thickness as it approaches the rim 32, as shown in FIG. 13, to provide more strength and resistance to flexing as the cap is screwed on.

The surface of the rim (32) has the same height around the entire perimeter in one plane, and includes the chord. The surface of the rim can be radiused, flat, angled or any other shape commonly known in the art. The sides of the rim can be flat, rounded or sloped. The rim comprises both the circular surface surrounding the opening and the chord section.

The finish (20) of the bottle (10) can include a neck region (28) having threads (30). The threaded neck region (28) provides a means for attachment of a similarly threaded cap (42). (FIG. 11) Snap fit caps are also contemplated. The cap (42) engages the finish (20) to provide a hermetic seal of the bottle (10).

It is to be understood that the bottle (10) can be made of plastic and can further include a metal, a glass, a plant-based polymer, a synthetic polymer, a natural fiber or mixtures thereof. Preferably, the bottle (10) is made from one or more synthetic polymers, such as polyethylene or polypropylene.

The inner seal (44), sometimes referred to as a liner, can be made of a metal, a plant-based polymer, a synthetic polymer, a natural fiber or mixtures thereof. The inner seal (44) can be attached by any convenient means such as by the use of an adhesive or by heat induction to the rim (32) of the opening (24) of the bottle (10). Most commonly, the inner seal (44) includes a multi-layer composite structure with an upper layer of metallic foil (50) that is adhered to a lower layer of adhesive material (48) that bonds the inner seal (44) to the bottle (10) upon heating. The inner seal (44) can also include an upper backing layer (46).

Generally, the inner seal (44) is placed into the cap (42) and shipped to a packaging company. The packaging company places the cap (42) onto a filled bottle (10) with the heat sealable material (48) being in contact with the rim (32) of the bottle (10). The bottle (10) then passes through a conduction or an induction heating system that conducts or inducts heat into the metallic foil (50). This heat treatment causes the temperature of the metallic foil (50) to increase, which melts the attached sealant (48), causing the metallic foil (50) to bond to the rim (32) of the bottle (10). One or more tabs (52) can be included for easy removal of the inner seal (44) by the user. The cap (42) serves to provide an airtight seal for the bottle (10).

The cap (42) is circular and fits over the rim (32) of the opening (24) of the bottle (10). The cap (42) can be made of a metal, a plant-based polymer, a synthetic polymer, a natural fiber or mixtures thereof. Preferably, the cap (42) is made from one or more synthetic polymers. The cap (42) has a top wall portion (54) and a depending skirt portion (40) that is attached to the top wall portion (54).

The bottle and cap assembly of the subject invention comprises a heat-sealable, plastic bottle including an opening and a rim having a circumferential sealing surface that forms the opening. The sealing surface of the bottle has a chord section with an internal scraping surface and has an external planar surface adjacent to the chord section. The planar surface of the internal scraper wall (36) can have a buttress supporting the chord section. There is an inner seal adhered to the rim, and optionally, a cap.

Also contemplated is a bottle and cap assembly that includes a heat-sealable, plastic bottle having a body with a lower section, a shoulder connected to the lower section, an upper section connected to the shoulder, and an upper neck connected to the upper section that defines a planar opening perpendicular to a longitudinal axis of the bottle. The opening has a planar sealing surface to which an inner seal is adhered, a planar ledge with a terminal edge attached to the upper neck and within the opening, and a cap attached to the top of the planar sealing surface.

With the subject invention, a user may insert a spoon into an open bottle having particulate matter inside, pick up the particulate matter with the spoon, withdraw the spoon while simultaneously dragging the spoon over the chord to level the particulate matter on the spoon, thereby allowing a consistent amount to be extracted from the bottle with such use.

From the foregoing, it will be observed that numerous variations and modifications may be effected without departing from the spirit and scope of the invention. It is to be understood that no limitation with respect to the specific article illustrated herein is intended or should be inferred. It is, of course, intended to cover by the appended claims all such modifications as fall within the scope of the claims.

The invention claimed is:

1. A heat-sealable, plastic bottle comprising:

a base;

a sidewall extending upwardly from the base to define an interior;

a cylindrical neck;

a rim including:

a circumferential segment having a first end and a second end; and, a chord extending between the first end and the second end of the circumferential segment;

an arcuate mouth defined by the rim for dispensing contents from the interior;

a closed circular segment extending between an upper end of the cylindrical neck and the chord, the closed circular segment defining an internal scraping surface overhanging a portion of the interior, the internal scraping surface having a series of strengthening ribs disposed along the chord to improve the structural integrity of the internal scraping surface;

wherein the internal scraping surface is spaced from an upper surface of the rim by a wall segment.

2. The heat-sealable, plastic bottle of claim 1, wherein each strengthening rib in the series of strengthening ribs is selected from the group consisting of a solid flat support, a solid rounded support, and an angled strap support.

3. The heat-sealable plastic bottle of claim 1, the strengthening ribs further comprising a sloped upper surface, wherein the series of strengthening ribs extend axially upward from the internal scraping surface and abut the outer wall of the chord.

4. The heat-sealable, plastic bottle of claim 1, the rim further comprising an upper interior surface having a flat portion and a rounded portion.

5. The heat-sealable, plastic bottle of claim 1, the upper interior surface of the rim further comprising an angled portion or vertex.

6. The heat-sealable, plastic bottle of claim 1, further comprising an inner seal bonded to the rim, wherein the inner seal comprises a material selected from the group consisting of a metal, a plant-based polymer, a synthetic polymer, and a natural fiber.

7. The heat-sealable, plastic bottle of claim 1, further including a cap removably fastened to the cylindrical neck of the bottle, wherein the cap removably overlays the inner seal.

8. A plastic container assembly comprising:

a bottle comprising:

a closed bottom end;

a sidewall extending upwardly from the closed bottom end;

a neck comprising:

a lower shoulder extending upwardly from the sidewall;

an annular wall having a thread;

an arcuate rim;

a closed overhang extending inwardly from a portion of the annular wall, the closed overhang having:

a planar base;

a linear lip extending upwardly from the planar base;

buttresses joining the planar base and the linear lip;

a passage defined by the arcuate rim and the linear lip;

a closure arrangement comprising:

a removable liner bonded to the arcuate rim and the linear lip to create an airtight seal; and, a threaded cap removably fastened to the thread of the annular wall, the threaded cap covering the liner.

9. The plastic container assembly of claim 8, the linear lip further comprising a first linear segment and a second linear segment joined at an apex.

10. The plastic container assembly of claim 8, wherein a thickness of the planar base increases in thickness between the annular wall and the linear lip in an axially inward direction.

* * * * *